US009721411B2

(12) United States Patent
Kauffmann et al.

(10) Patent No.: US 9,721,411 B2
(45) Date of Patent: Aug. 1, 2017

(54) PROXIMITY-INITIATED PHYSICAL MOBILE DEVICE GESTURES

(71) Applicant: Google Inc., Mountain View, CA (US)

(72) Inventors: Alejandro Jose Kauffmann, San Francisco, CA (US); Boris Smus, San Francisco, CA (US)

(73) Assignee: Google Inc., Mountain View, CA (US)

( * ) Notice: Subject to any disclaimer, the term of this patent is extended or adjusted under 35 U.S.C. 154(b) by 348 days.

(21) Appl. No.: 14/228,981

(22) Filed: Mar. 28, 2014

(65) Prior Publication Data

US 2015/0269797 A1 Sep. 24, 2015

Related U.S. Application Data

(60) Provisional application No. 61/954,718, filed on Mar. 18, 2014.

(51) Int. Cl.
*G07C 9/00* (2006.01)

(52) U.S. Cl.
CPC ..... *G07C 9/00309* (2013.01); *G07C 9/00563* (2013.01); *G07C 2009/00793* (2013.01); *G07C 2209/63* (2013.01)

(58) Field of Classification Search
CPC ..... G07C 9/00111; G07C 9/00309; G07C 9/00563; G07C 2209/63; G07C 2009/00793
USPC ..... 340/5.61
See application file for complete search history.

(56) References Cited

U.S. PATENT DOCUMENTS 5,598,187 A * 1/1997 Ide ..... G06F 3/0346 345/156
8,125,312 B2 2/2012 Orr
8,378,782 B2 2/2013 Orr
8,564,535 B2 10/2013 Ullrich et al.
2010/0328201 A1* 12/2010 Marvit ..... G06F 1/1613 345/156
2011/0163944 A1* 7/2011 Bilbrey ..... G01D 21/02 345/156
2012/0038550 A1 2/2012 Lemmey et al.
2012/0135680 A1* 5/2012 Deluca ..... H04B 5/0031 455/41.1
2012/0280789 A1* 11/2012 Gerhardt ..... G07C 9/00309 340/5.61
2013/0065648 A1* 3/2013 Kim ..... G06F 21/31 455/566

(Continued)

FOREIGN PATENT DOCUMENTS

WO 2012/067948 5/2012
WO 2012104772 8/2012

OTHER PUBLICATIONS

Lavrinc, Damon, "Your Smartphone Will Replace Your Car Keys by 2015", Wired.com dated Dec. 27, 2012; http://www.wired.com/autopia/2012/12/death-to-the-key-fob/.

*Primary Examiner* — Edwin Holloway, III
(74) *Attorney, Agent, or Firm* — Fish & Richardson P.C.

(57) ABSTRACT

An interaction spot is provided that may detect the presence of an electronic device such as a smartphone. A user may make a physical motion with the smartphone proximal to the interaction spot such as moving it upward. The interaction spot may communicate with a second device such as a light or a household appliance. A setting of the second device may be adjusted based on the motion of the electronic device.

31 Claims, 10 Drawing Sheets

(56) References Cited

U.S. PATENT DOCUMENTS

2013/0344862 A1 12/2013 Alameh et al.

* cited by examiner

PROXIMITY-INITIATED PHYSICAL MOBILE DEVICE GESTURES

CROSS REFERENCE TO RELATED APPLICATIONS

This application claims priority to provisional application No. 61/954,718 that was filed on Mar. 18, 2014.

BACKGROUND

Gestural and/or voice interfaces may be used to control an electronic device. Such interfaces are convenient because they allow a user to interact with the electronic device without having to touch the device. Interfaces are also routinely simplified for the benefit of an end user. For example, many cars contain a push-button ignition that replaces the conventional key-based ignition. Other devices, such as door locks, have been made to be "smart" in that they allow a user to access the lock when a device, such as a smartphone, has been authenticated and is in proximity to the lock.

BRIEF SUMMARY

According to an implementation of the disclosed subject matter, a signal indicating a presence of an electronic device may be received by an interaction spot. The interaction spot may include a communication module and a processor. An indication of a motion may be received from the electronic device. The motion may be based on a change from a first physical orientation to a second physical orientation of the electronic device. A signal indicating an action may be dispatched based on the motion. The action may cause an adjustment of a setting of a second device that is physically distinct from the electronic device based on the motion of the electronic device.

A system is disclosed that includes an electronic device, a second device, and an interaction spot. The electronic device may be configured to send an indication of a motion to the interaction spot. The motion may be based on a change from a first physical orientation of the electronic device to a second physical orientation of the electronic device. The second device may be configured to receive an indication of an action and perform the action. The action may result in an adjustment of a setting of the second device. The interaction spot may be configured to receive a signal indicating a presence of the electronic device. The interaction spot may include a communication module and a processor. It may receive, from the electronic device, the indication of the motion. The motion may be based on a change from a first physical orientation of the electronic device to a second physical orientation of the electronic device. The interaction spot may dispatch the indication of the action based on the motion.

In an implementation, a signal indicating a presence of an electronic device may be received by an interaction spot. The interaction spot may be mounted in a stationary position and include a communication module and a processor. A first indication of a first physical orientation of the electronic device may be received. A second indication of a second physical orientation of the electronic device may be received. A setting of a second device that is physically distinct from the electronic device may be adjusted based on a motion of the electronic device.

In an implementation, a signal may be sent to an interaction spot by an electronic device that indicates a presence of the electronic device near the interaction spot. A first indication of a first physical orientation may be sent and a second indication of a second physical orientation may be sent. A setting of a second device that is physically distinct from the electronic device may be adjusted based on a motion of the electronic device. The motion of the electronic device may include a change from the first physical orientation to the second physical orientation.

As disclosed herein, a system is provided that includes an interaction spot. The interaction spot may have a communication module and a processor. It may be mounted in a stationary position and configured to receive a signal indicating a presence of an electronic device. The interaction spot may receive a first indication of a first physical orientation of the electronic device and it may receive a second indication of a second physical orientation of the electronic device. The interaction spot may adjust, directly or indirectly, a setting of a second device that is physically distinct from the electronic device based on a motion of the electronic device. The motion of the electronic device may include a change from the first physical orientation to the second physical orientation.

A device is disclosed that includes a communication module and a processor. The device may be configured to send and receive data via the communication module. The processor may interpret the data sent or received by the communication module. It may issue commands to send or receive the data and/or commands based thereon to the communication module and/or a second and/or third device. The communication module may be configured to detect a presence of an electronic device in a proximity to the device and receive at least one indication of a physical orientation of the electronic device from the electronic device. The processor may be configured to transmit the at least one indication of a physical orientation of the electronic device to a second device. A setting of a third device may be adjusted based on the at least one indication of the physical orientation of the electronic device. The third device and the electronic device may be physically distinct from one another.

In an implementation, a system according to the presently disclosed subject matter includes a means for receiving, by an interaction spot, a signal indicating a presence of an electronic device. The interaction spot may include a communication module and a processor. The system may include a means for receiving, from an electronic device, an indication of a motion. The motion may be based on a change from a first physical orientation of the electronic device to a second physical orientation of the electronic device. The system may include a means to dispatch an action based on the motion. The action may result in an adjustment of a setting of a second device that is physically distinct from the electronic device based on the motion of the electronic device.

Additional features, advantages, and implementations of the disclosed subject matter may be set forth or apparent from consideration of the following detailed description, drawings, and claims. Moreover, it is to be understood that both the foregoing summary and the following detailed description provide examples of implementations and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 3:
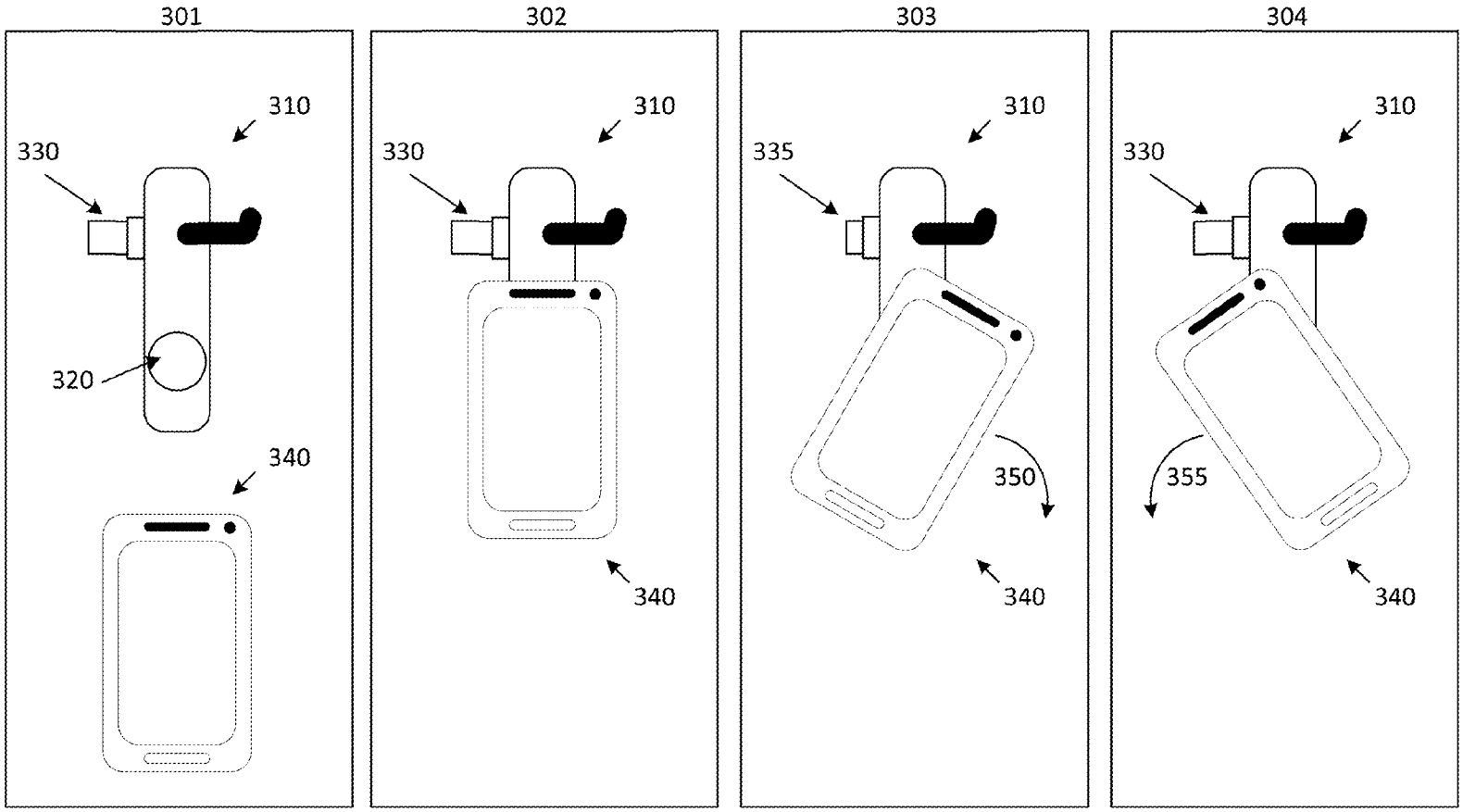
FIG. 3 shows an example of an interaction spot being used to lock and unlock a door as disclosed herein.

As disclosed herein, a mobile device's sensor readings may be utilized with a physical interaction spot to control real-world electronic or mechanical devices or objects. The interaction, therefore, with an electronic or mechanical device or object is not abstracted to pressing a button, performing a gesture, speaking a command, or touching a glass screen. FIG. 3 is an example of a front door lock being controlled according to an implementation disclosed herein. In the first pane 301, a door lock 310 and smartphone 340 are shown. The door lock 310 contains a dead bolt in an extended position 330 and an interaction spot 320. The smartphone 340 may be associated with a user's identity. A user may utilize the phone 340 to unlock the door by placing it on the interaction spot 320 as shown in the second pane 302. In the third pane 303 the user may retract the deadbolt 335 by rotating the phone 340 to the right 350, thus unlocking the door. Similarly, the phone 340 may be rotated to the left 355 while the phone 340 is hovered above or contacted with the interaction spot 320 (only shown in the first pane 301) to cause the deadbolt to extend 330, thereby locking the door as shown in the fourth pane 304. The amount of rotation required to cause the deadbolt to retract or extend may be preset by the door manufacturer or configured by an end user. In many configurations a rotation in the range of 10-90 degrees will be most user friendly because the user will not need to contort the hand into an unnatural or uncomfortable position. But other degrees of rotation or movement may be utilized in accordance with implementations disclosed herein.

Figure 4:
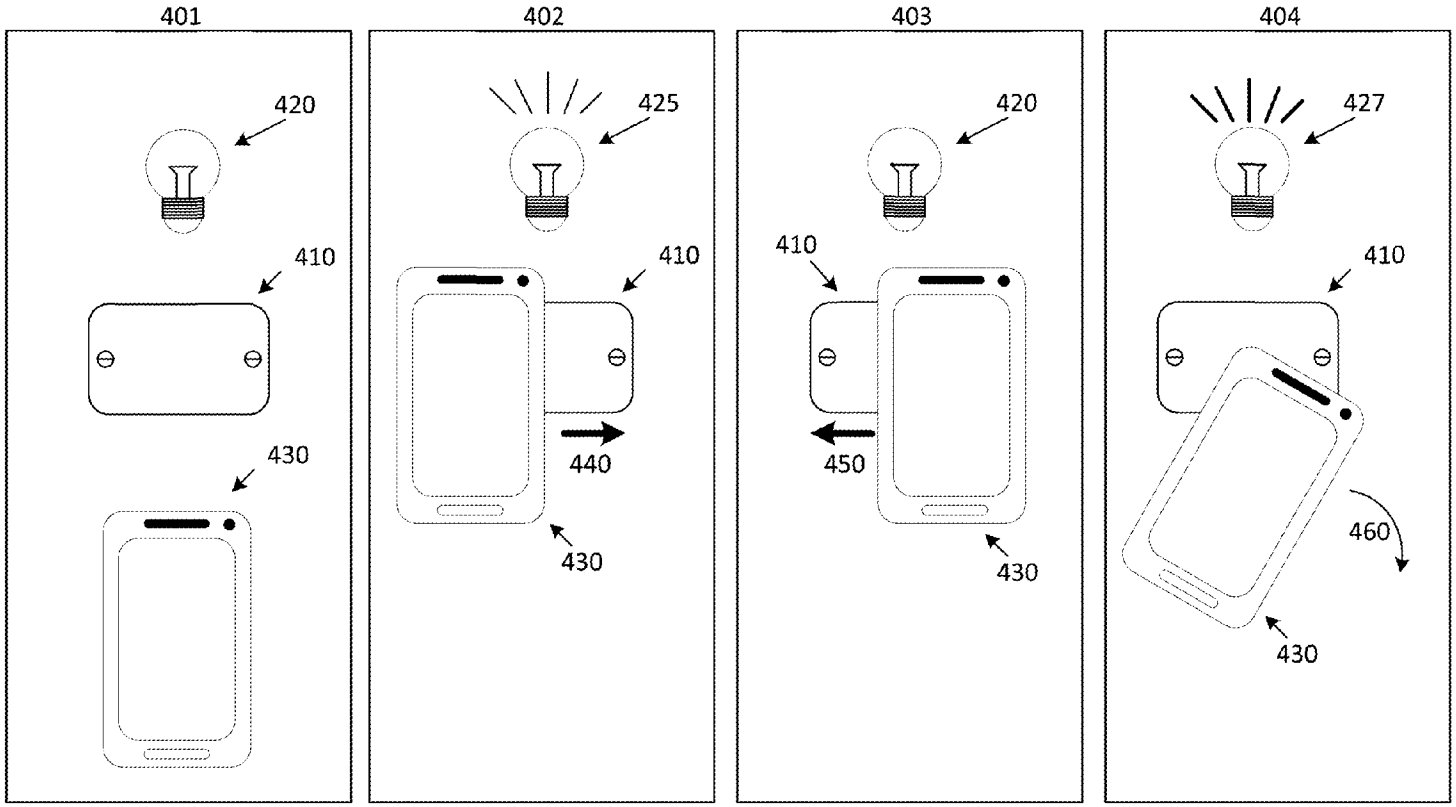
FIG. 4 shows an example of an interaction spot being used to turn a light switch on or off and/or to dim the light switch as disclosed herein.

FIG. 4 shows an example of a light switch that can be controlled according to an implementation disclosed herein. In the first pane 401, an interaction spot 410 may be covered with a conventional wall cover plate as shown in FIG. 4 or the cover plate may be the interaction spot 410. Thus, the interaction spot may be exposed or lightly concealed such that the interaction spot 410 is able to detect the presence of and maintain communication between the electronic device (e.g., a smartphone 430). The light bulb 420 is controlled by the interaction spot. The interaction spot 410 may take the place of a conventional light switch. The smartphone 430 may be placed in proximity to or contacted with the interaction spot 410 as shown in the second 402, third 403, and fourth 404 panes. The interaction spot may be operable in a range of 0-20 cm. The interaction spot may communicate with or detect the presence of an electronic device such as a smartphone using short range wireless technology (e.g., Bluetooth, near-field communication ("NFC"), etc.) and/or actual physical contact. As shown in the second pane 402, when the user moves the smartphone 430 to the right 440, the light is turned on 425. In the third pane 403, when the user moves the smartphone 430 to the left, the light is turned off 420. An interaction spot 410 may have multiple physical movements associated with it. For example, in the fourth pane 404, a user may rotate the smartphone 430 to the right 460 to increase the intensity of the light 427. Similarly, the smartphone may be rotated to the left to decrease the intensity of the light.

Figure 5:
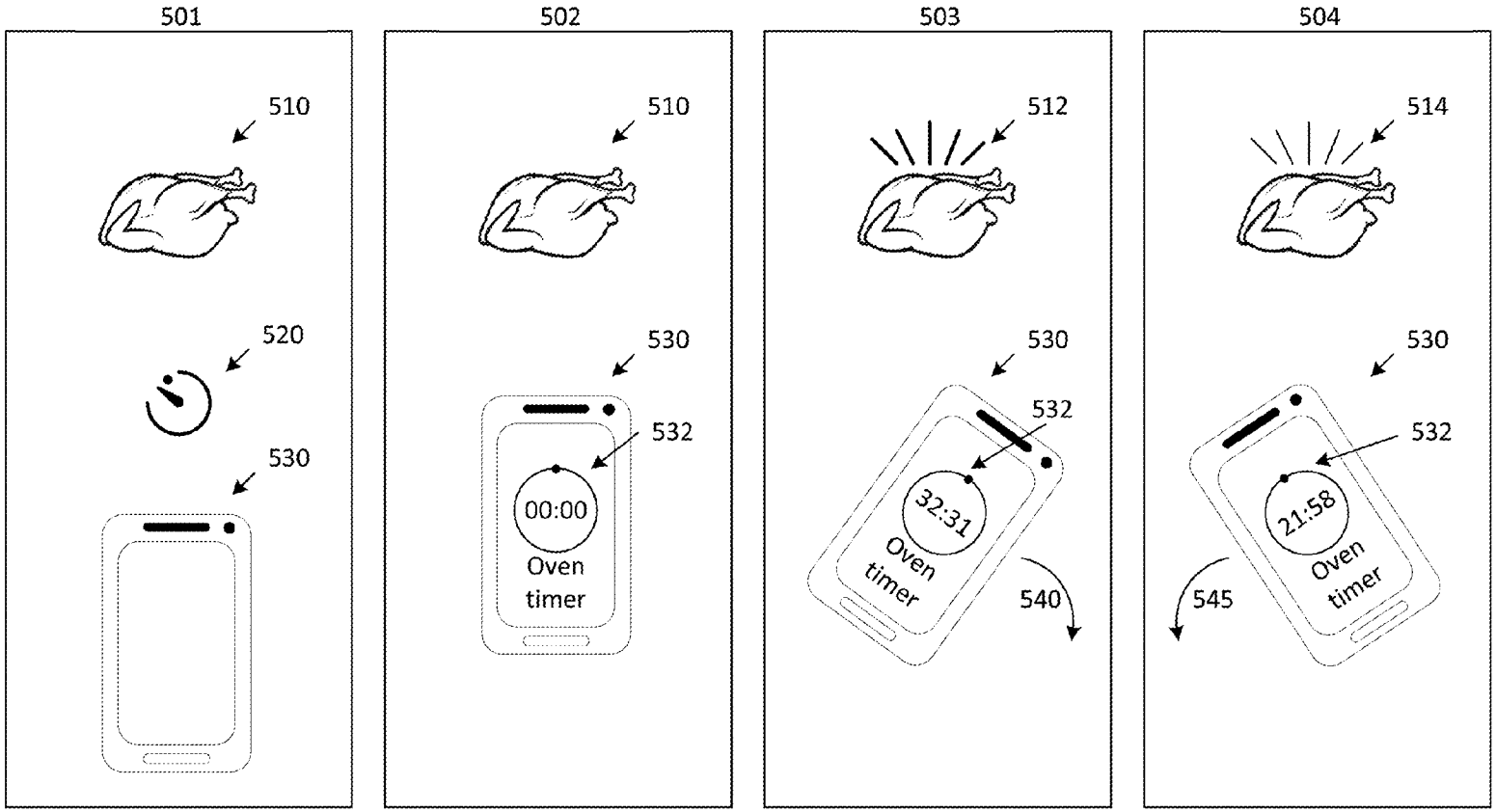
FIG. 5 shows an example of an oven timer setting being adjusted by physical movement of a user's smartphone as disclosed herein.

As another example, a stereo may include an interaction spot and a user may utilize the interaction spot to, for example, increase or decrease the volume of the stereo. An interaction spot may be located in a kitchen on an appliance as shown in the example in FIG. 5. In the first pane 501, an interaction spot 520 may be present on an oven in which the user has placed a chicken 510. A user may place a smartphone 530 over the interaction spot 520 to control a feature of the oven as shown in the second pane 502. In this example, the interaction spot may allow a user to control a timer on the oven. Upon detecting the presence of the smartphone 530, the interaction spot 520 may send a signal to the smartphone 530 alerting the smartphone 520 to its detection. In some configurations, the smartphone 530 may have an API or an application that receives the detection signal from the interaction spot 520 and causes it to display a representation of the function 532 that can be controlled with the particular interaction spot 520. For example, the interaction spot 520 may communicate an alphanumeric code to the smartphone 520 that an application running on the smartphone 520 determines to be associated with a particular function (e.g., a timer, on/off, dimming, etc.). In the third pane 503, the user may rotate the smartphone 530 to the right 540 to increase the amount of time that the oven will bake the chicken 512. Similarly, if the smartphone 530 is rotated to the left 545, it may decrease the amount of time for baking the chicken 514. The display of the function 532 on the smartphone 530 may be adjusted as the user rotates or moves the device as shown in the third and fourth panes 503, 504.

Figure 6:
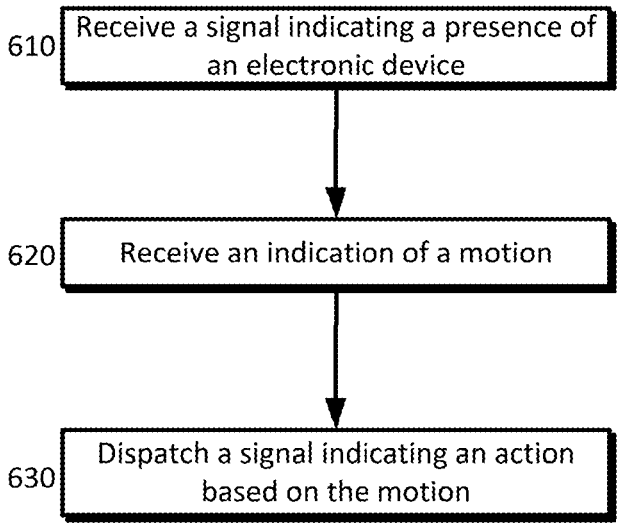
FIG. 6 shows an example process for adjusting a setting of a second device based on the physical orientation of an electronic device as disclosed herein.

In an implementation, an example of which is provided in FIG. 6, an interaction spot may receive a signal indicating a presence of an electronic device at 610. The interaction spot may include a processor and a communication module. The communication module may communicate with an electronic device (e.g., a smartphone), a server, and/or a second device (e.g., an appliance) using a variety of technologies such as near-field communication ("NFC"), a radio frequency identification ("RFID"), a local area network, an inductive detector, a magnetic detector, and Bluetooth. These same technologies may be utilized to detect the presence of the electronic device. For example, an electromagnetic field emitted by the electronic device may be received as the signal by an NFC chipset of the interaction spot. The processor of the interaction spot may dispatch instructions to the communication module such as instructing the communication module to dispatch an indication of a motion or action to a server, a second device such as an appliance, and/or the electronic device. As another example, a phone's magnetometer may be utilized to identify the proximity of a magnetic field and/or the particular field (e.g., through pulsing, changes in orientation, or a combination thereof).

The interaction spot may be mounted to a device, mounted in a stationary position, or be a component of a moveable object. In some configurations, the interaction spot may be physically distinct or disconnected from the object it controls or the second device (e.g., an appliance). That is, wireless communication may be the only connection between the interaction spot and the second device. In some configurations, the interaction spot may be mounted to an appliance, in place of a conventional wall light switch, in place of a key mechanism for a door, etc.

An indication of a motion may be received from the electronic device at 620. The motion may be based on a change from a first physical orientation of the electronic device to a second physical orientation of the electronic device. The electronic device may be, for example, a mobile phone, a tablet, or other portable electronic device. The electronic device's inertial measurement unit ("IMU") may determine its orientation, for example, based on an accelerometer's, magnetometer's and/or gyroscope's data. The IMU, therefore, may determine that the device is oriented at a particular angle with respect to a three dimensional space. That is, the IMU may determine the plane of the electronic device with respect to an x-, y-, and z-axis position. Other sensors on board the electronic device or connected thereto, such as a GPS, a camera, a gyroscope, a magnetometer, etc., may be utilized to complement the IMU's sensor data or in place thereof. The electronic device may communicate to the communication module of the interaction spot its physical orientation based on the IMU's sensor data. The signal referred to at step 610 above may be or be coincident with the communication of the electronic device's physical orientation or the electronic device's physical orientation communication to the interaction spot may be the signal indicating the presence of the electronic device. For example, if the interaction spot's communication module is composed of a NFC chipset, the chipset may become activated only when the electronic device is within approximately ten centimeters of the interaction spot and the electronic device may automatically send its orientation information to the chipset upon detecting it.

The indication of a motion may be the electronic device's communication about its physical orientation to the communication module of the interaction spot. The electronic device may send more than one communication to the interaction spot and each communication may correspond to a different physical orientation of the electronic device. In some configurations, the electronic device may communicate a motion based on a change from a first physical orientation to a second physical orientation. For example, if a user holds a smartphone up to an interaction spot mounted on a door similar to the example shown in FIG. 3 and slides the smartphone from left to right, the phone may communicate the motion of the phone to the communication module of the interaction spot. In some configurations, the electronic device may communicate an indication of an action to the communication module. For example, the phone may communicate an indication of an action such as turn on light or unlock door based on a motion of the electronic device (e.g., an upwards motion or gesture). The interaction spot may receive the communication as an indication of the action based on a motion (e.g., sliding the phone left to right to unlock a door or moving the phone in an up/down motion to turn the a light on or off). In some configurations, the electronic device may communicate raw motion data to the interaction spot.

The first physical orientation of the electronic device and the second physical orientation of the electronic device may be a portion of a continuous motion. For example, a user may rotate the electronic device to dim a light as shown in the example provided in FIG. 4. The first physical orientation of the electronic device may refer to the device's position at zero degrees and the second physical orientation of the electronic device may refer to the device's position at one degree of rotation relative to the first physical orientation. The electronic device may be rotated an additional amount and an indication of such rotation may be sent to the communication module of the interaction spot. In some configurations, rather than send multiple signals for each incremental change in physical orientation, the electronic device may send the final amount of rotation. For example a user may rotate a phone fifteen degrees to the left to decrease the intensity of a light by fifteen percent. Rather than send a communication in real time for each minute amount of rotation (e.g., for each degree of rotation), the electronic device may wait for the user to stop rotating it and then send an indication of the amount of rotation to the interaction spot. The electronic device may determine a user has stopped rotating the electronic device when the user pauses or ceases rotating the device for a predetermined amount of time (e.g., a few seconds).

At 630, a signal indicating an action may be dispatched based on the motion. The indication of the action may be a computer-readable command or code, for example. The action may cause, directly or indirectly, an adjustment of a setting of a second device that is physically distinct from the electronic device based on the motion of the electronic device. Whether the action is determined by the interaction spot based on data received from the electronic device, is communicated by the electronic device to the interaction spot, or is determined by another device (e.g., a second device or server), the action, or an indication thereof, may be communicated, directly or indirectly, to a second device. The second device may be, for example, a household appliance, a television, a stereo, a door lock, a timer, a payment transaction device (e.g., a credit card reader), and a light switch. A payment transaction device may refer to a device that can debit funds from an account of an individual and/or credit funds to an account of another entity (e.g., person or business). The setting of the second device may be, for example, on, off, an intensity setting, lock, and unlock. A setting may refer to a state of a second device. For example, a light (e.g., a second device) may be instructed to turn on (e.g., an action) and change its state from "off" to "on," thereby having a current state or setting of "on." A setting may refer to a security or access setting (e.g., locked or unlocked), a power setting (e.g., on or off) and/or an intensity as described herein. Other settings (e.g., volume up/down, channel up/down, brightness up/down, a timer setting, etc.) for other "second devices" such as a stereo may be used according to implementations disclosed herein. Examples of such functions have been described above and in FIGS. 3-5.

The interaction spot may dispatch a signal indicating an action directly to the second device based on the motion of the electronic device. For example, an interaction spot may be mounted directly on a stove. The interaction spot may dispatch a signal indicating an action to adjust a setting for the timer of the oven to a thirty minute cooking time. Thus, the action may refer to adjusting the timer while the setting may be the amount of the adjustment (e.g., thirty minutes). As another example, an action may be to turn on a light while the setting may refer to the light's state as being on. The signal indicating the action may be a command and the setting may be the effect of that command. In some configurations, the action and the setting may be the same. For example, an action may be to turn on a light at thirty percent intensity and the setting may be the light set at thirty percent intensity. The motion received from the electronic device may be an upwards motion similar to flicking a light switch on. An action and/or a signal indicating an action may refer to a translation of the motion into a useable command by the second device. For example, the electronic device may communicate a clockwise rotation of thirty degrees to the interaction spot. The interaction spot may determine that, for the particular second device it is associated with, a clockwise thirty degree rotation corresponds to a command to intensify a light emission by thirty percent (i.e., the action) and the setting of the second device (i.e., the light) may be adjusted accordingly (i.e., the intensity of the light may be increased by or set to thirty percent).

A signal indicating an action may be dispatched to a variety of devices such as a remote server, an infrared blaster, the second device, and a local server. For example, a user may have indicated a desire to unlock a front door by sliding a smartphone from left to right over the interaction spot. The motion (i.e., left to right movement) may be associated with an action (i.e., unlock front door and/or an access request to the front door) that is dispatched to a remote server. The interaction spot or the second device (i.e., the door lock) may receive a response from the remote server in which the access request has been granted. The remote server may validate the user's identity by comparing the access request to information stored on the server about the user. The user's electronic device may send the interaction spot a personal identification number ("PIN") that uniquely identifies the user with the motion data. The interaction spot may forward the PIN and the action as a request for access to the server. The server may compare the PIN to one stored in a database. If the PIN matches, the server may return a response to the interaction spot and/or the second device indicating that the access request is valid. The PIN number in the database may be entered, for example, by a user upon establishing the connection between the door lock and the user's phone. A response from the server deeming the access request valid may grant access to the front door (e.g., cause a deadbolt to retract). The server may validate a user in other ways. For example, it may access a camera positioned near the front door and perform facial recognition on an image captured of the user attempting to gain access to the door. If the image captured by the camera sufficiently matches the one it has stored in a database, the user may be granted access. In some configurations, the access request may be associated with the motion the user makes with the electronic device (e.g., sliding to unlock the door may be the access request). In some configurations, a user may hold an electronic device near the interaction spot before performing any motion or pausing before performing a motion. The presence of the electronic device near the interaction spot or a pause before performing a motion may constitute an access request.

In some configurations, an electronic device may display an indication of the setting being controlled. For example, it may show a timer control function (see FIG. 5) or a light switch knob. The electronic device may receive an indication from the interaction spot of the setting. The indication may be utilized by an application operating on the electronic device to determine a type of graphical representation to display on the electronic device for the setting being controlled by the interaction spot.

An interaction spot may control more than one device (e.g., including the second device) and it may control more than one function of a device. An indication of the device that the interaction spot is associated with may be sent to the electronic device. For example, a user may be presented with an interface that permits the user to select the device the user would like to control. The indication of the devices may be received by an application running on the user's device and it may present the user with an interface that can be used to select a device. For example, an interaction spot may control an oven and a light. A user may select control of the light switch. An indication of this selection may be sent to the interaction spot. In some configurations, the application running on the user's device may display on the user's electronic device a light switch knob. Subsequent to the user making a motion with phone, the electronic device may send the interaction spot an indication of the motion. The selection of a device may be indicated by, for example, an alphanumeric code that is communicated with the motion of the electronic device.

A user may make more than one motion with an interaction spot. For example, a user may make a physical motion of the smartphone to indicate a desire to turn on a light. Similarly, the user could rotate the phone to indicate a desire to brighten or dim the same light. Thus, a second motion may be received by the interaction spot that differs from a first motion. A second device, therefore, may have multiple settings, each of which can be adjusted based on a received signal of an action. An oven, for example, may have multiple settings that can be adjusted using an electronic device such as an oven light, a temperature setting, and/or a timer setting. Upon interfacing with the interaction spot, the electronic device may display a list of settings that can be controlled for the particular second device (e.g., the oven) that is associated with the interaction spot. A user may select the setting the user would like to adjust. An indication of that selection may be received by the interaction spot and communicated, directly or indirectly, to the second device.

A second device may be associated directly or indirectly with an interaction spot. In some configurations, the interaction spot may dispatch an action to a server. The server may, based on the action, identify the second device associated with the action. For example, a user may link an oven to a particular uniform resource indicator ("URI") on a server. Thus, the oven may be connected to a user's local area network ("LAN") and be capable of receiving instruction from the server. When the interaction spot is dispatched to the server, it may identify the particular interaction spot so that the server may know which device to control and for which household, for example. Thus, a household may have multiple interaction spots, each spot may control, directly or indirectly, one or more devices, and each spot may control one or more settings for each device that it controls. As an example, a user may configure the association of an interaction spot and/or a second device with a server such as creating unique URI for each spot and/or device.

A light and/or sound may be emitted in connection with the interaction spot. For example, when a user unlocks a door, the interaction spot may indicate the access request has been granted by illuminating one or more green light emitting diodes ("LED"). It may also play a sound such as a key turning in a lock or a chime.

Figure 7:
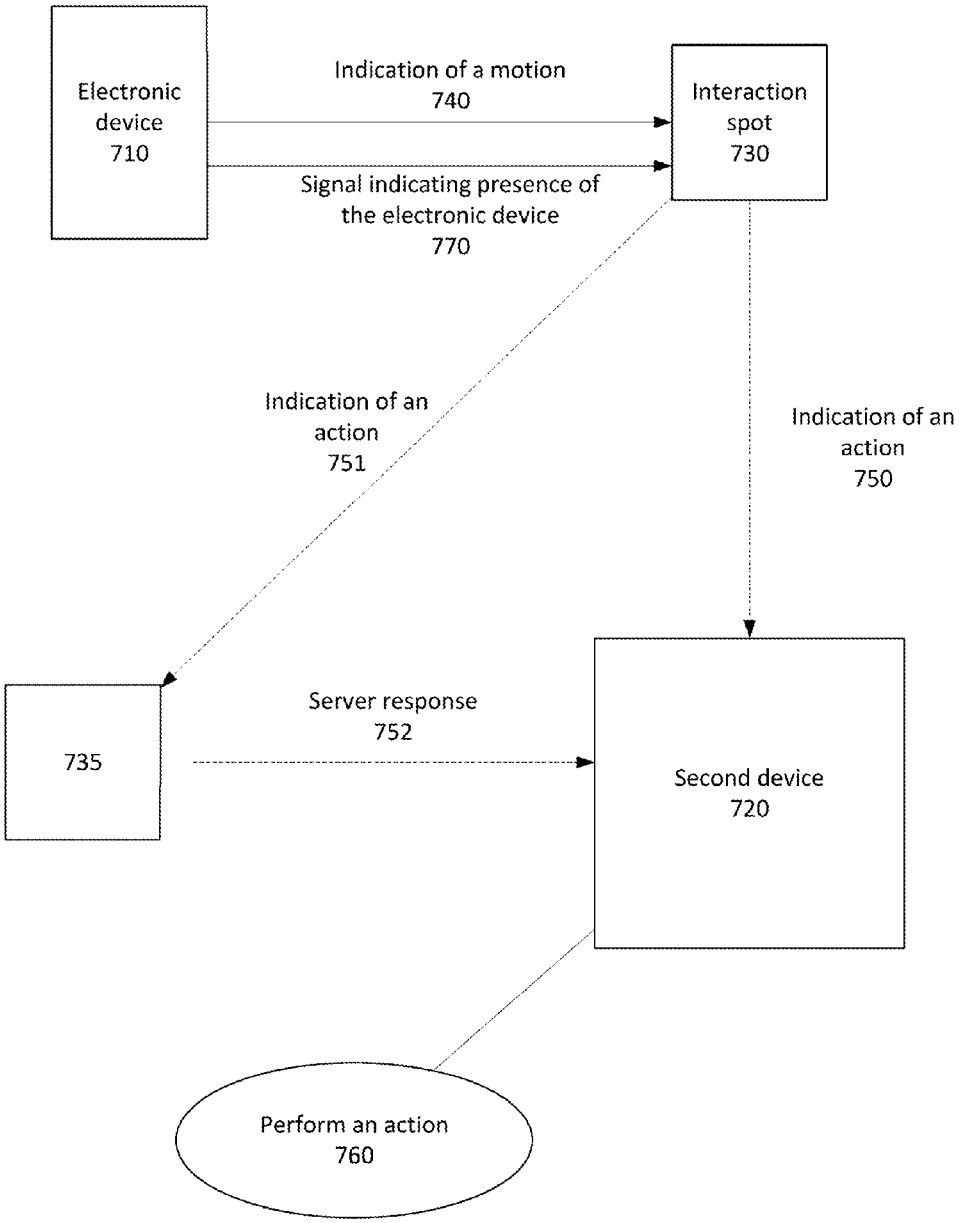
FIG. 7 shows an example system for adjusting a setting of a second device based on the physical orientation of an electronic device as disclosed herein.

In an implementation, a system is provided that includes an interaction spot 730 and may include an electronic device 710 and/or a second device 720 as shown in the example provided in FIG. 7. The electronic device 710 may be configured to send an indication of a motion 740 to the interaction spot 730 as described above. The motion 740 may be based on a change from a first physical orientation of the electronic device to a second physical orientation of the electronic device. For example, a user may approach an interaction spot 730 with a smartphone 710 and move the smartphone 710 in a left-right motion to indicate that the user would like to unlock a door. As described above, the electronic device 710 may send a signal indicating its presence 770 to or near the interaction spot 730.

The second device 720 may be configured to receive an indication of an action 750 and perform the action 760. The action may result in the adjustment of a setting of the second device 720. The interaction spot 730 may be configured to receive a signal indicating a presence of the electronic device as described above.

The interaction spot 730 may include a communication module and a processor. It may receive, from the electronic device 710, the indication of the motion 740. The motion may be based on a change from a first physical orientation of the electronic device to a second physical orientation of the electronic device 710. The interaction spot 730 may dispatch an action based on the motion to the second device 720, 750 or to a server 735, 751 for example. As described earlier, the interaction spot 730 may be mounted in a stationary position such as in place of a vehicle ignition switch.

In some configurations, the system may further include a server 735 that is configured to receive the action 751 from the interaction spot 730. For example, as stated above, the action may be or include an access request. The server may determine the access request is valid and send a response to the second device 752. The response 752 may indicate that the access request is valid. The second device 720 may receive the response 752 to the access request and grant access to the second device if the server has deemed the access request valid.

Figure 8:
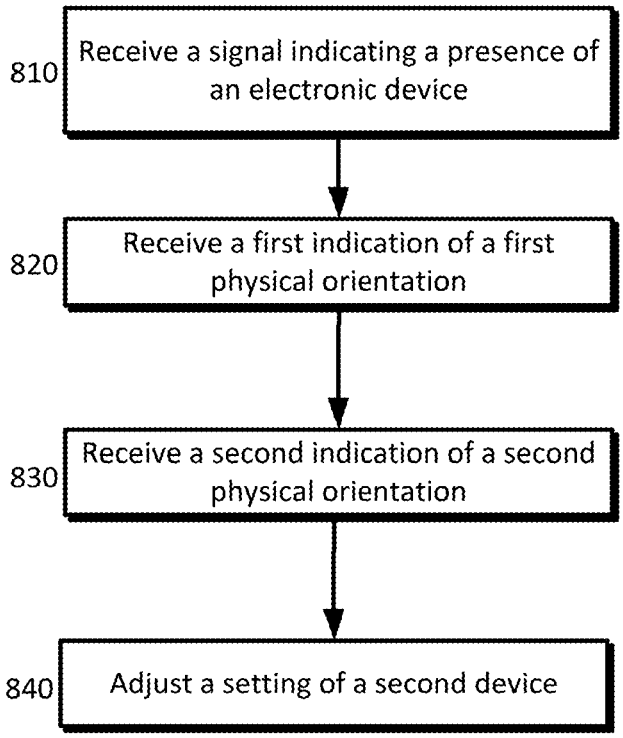
FIG. 8 shows an example process for an interaction spot to receive a first physical orientation and a second physical orientation and adjust a setting of a second device as disclosed herein.

In an implementation, an example of which is provided in FIG. 8, an interaction spot may receive a signal indicating a presence of an electronic device at 810 as described above. The interaction spot may be mounted in a stationary position and include a communication module and a processor. A first indication of a first physical orientation of the electronic device may be received at 820. A second indication of a second physical orientation of the electronic device may be received at 830. For example, an electronic device may communicate its position at a first time point (e.g., first physical orientation) and a second time point (e.g., second physical orientation) to the interaction spot. The interaction spot may determine the motion of the electronic device based on the change from the first physical orientation to the second physical orientation. A setting of a second device that is physically distinct from the electronic device may be adjusted based on a motion of the electronic device at 840 as described above. For example, the interaction spot may determine that the motion of the phone is an upwards one and determine that such a motion is associated with a "turn on light" action. It may adjust the power setting of the light, therefore, to an "on" state based on the upward motion. In some configurations, the interaction spot may send a server the first physical orientation and the second orientation. The server may determine the motion and determine what setting is being adjusted based on the motion. The server may communicate the adjustment of the setting to the second device.

Figure 9:
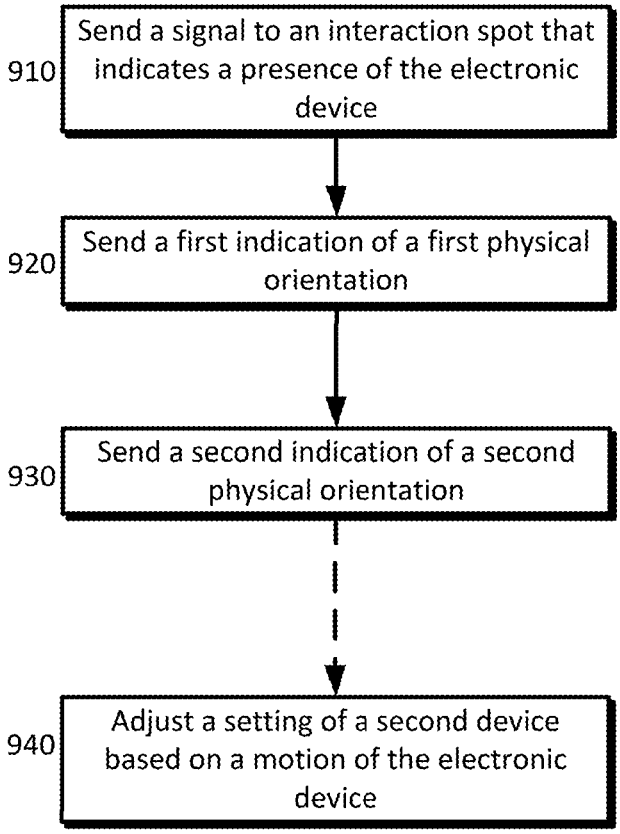
FIG. 9 shows an example process for an electronic device to communicate a first physical orientation and a second physical orientation to an interaction spot as disclosed herein.

In an implementation, an example of which is provided in FIG. 9, an electronic device may send a signal to an interactive spot that indicates a presence of the electronic device near the interactive spot at 910 as described above. In some configurations, the electronic device may communicate a motion based on a movement it detects, for example, by its IMU. The motion may correspond to a change from a first physical orientation to a second physical orientation. In some configurations, the electronic device may communicate an action based on a motion it has detected such as "turn on light." In FIG. 9, the electronic device may send a first indication of a first physical orientation at 920 and a second indication of a second physical orientation at 930. The indication, for example, may be raw data from the electronic device's IMU or it may correspond to a portion thereof. A setting of a second device that is physically distinct from the electronic device may be adjusted based on a motion of the electronic device at 940.

As described earlier, the electronic device may send an access request to the interactive spot. The interactive spot may communicate the access request to a remote server and receive a response from the remote server granting the access request. The granting of the access request may permit access to the second device (e.g., a door lock). The access request may be received from the electronic device based on the motion. That is, sliding a smartphone over the interactive spot to unlock the door may be the access request.

The electronic device may receive an indication of one or more devices that may be interacted with through the interaction spot. A user may select one of the devices (e.g., the second device) to control and the electronic device may communicate the selection the interaction spot separately or coincident with an indication of its physical orientation. Similarly, the electronic device may graphically display a setting for the second device. As a user makes a motion with the electronic device, the motion may be reflected on the display of the electronic device.

Figure 10:
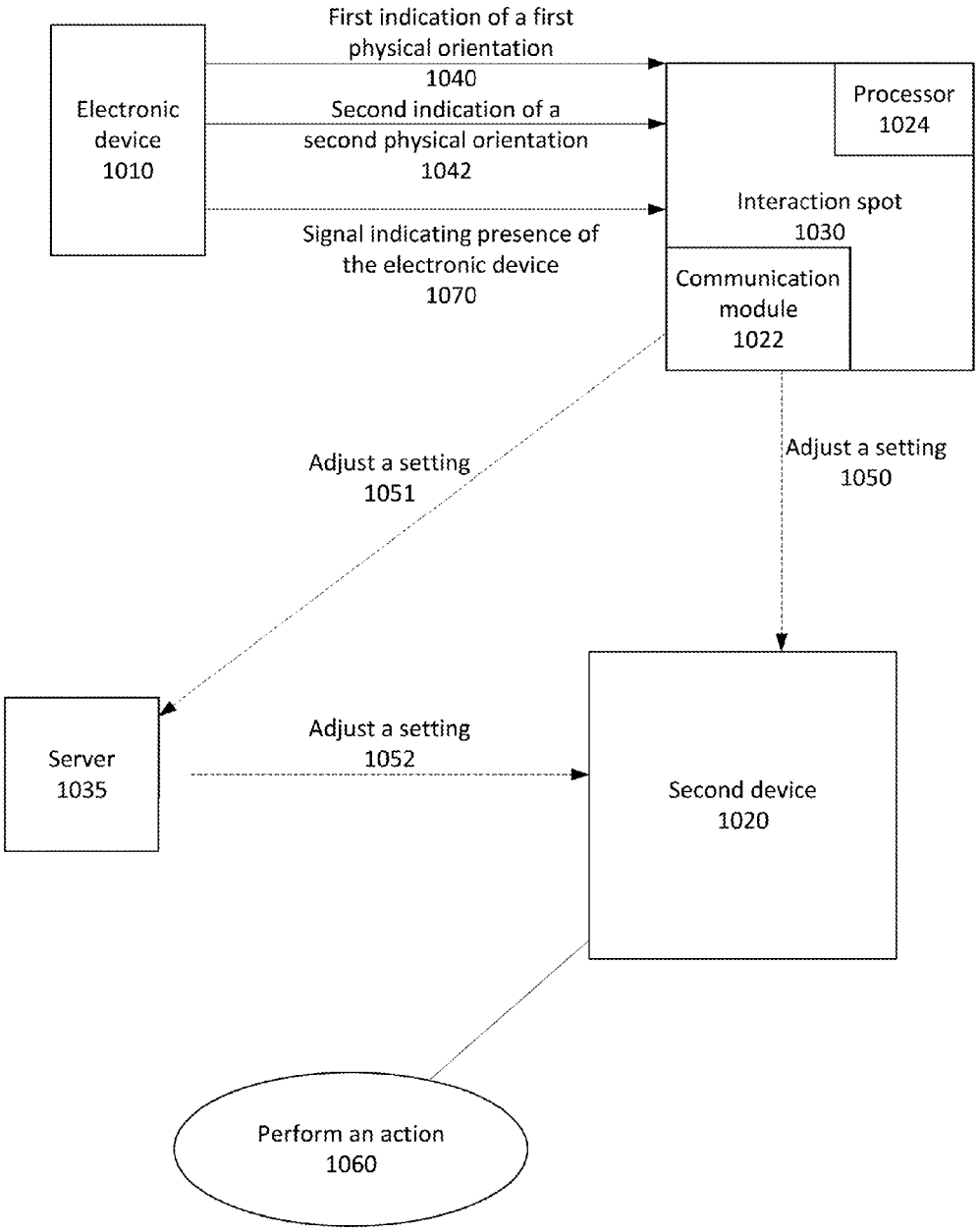
FIG. 10 shows an example system for an electronic device to communicate a first physical orientation and a second physical orientation to an interaction spot as disclosed herein.

A system, such as the example in FIG. 10, is provided that includes an interaction spot 1030 is provided. The interaction spot 1030 may include a communication module 1022 and a processor 1024 as described above. The interaction spot 1030 may be configured to receive a signal indicating a presence 1070 of an electronic device 1010. The interaction spot 1030 may receive a first indication of a first physical orientation 1040 of the electronic device 1010 and a second indication of a second physical orientation 1042 of the electronic device 1010. The interaction spot 1030 may adjust a setting 1050 of a second device 1020 based a motion discerned from the first physical orientation and the second physical orientation. For example, the interaction spot may communicate directly with a second device (e.g., a household appliance) or it may communicate indirectly 1051 through an intermediary such as a server 1035 as described above. The server 1035 may then send a signal to adjust a setting 1052 of the second device 1020. The second device 1020 may perform an action 1060 to adjust the setting.

The system may include an electronic device 1010 that includes a display, a second processor, and a second communication module. The electronic device may send the signal to indicate its presence to the interaction spot 1070. For example, a second communication module may indicate to the second processor that it is in range of an interaction spot. The second processor may transmit, via the communication, a short message to the interaction spot to indicate that it would like to interact with it (e.g., the signal). The electronic device may be configured to send the first indication of the first physical orientation 1040 and the second indication of the second physical orientation 1042.

A server 1035 may be included in the system. The server 1035 may be configured to receive an access request from the interactive spot. The access request may include at least one feature of the electronic device 1010. For example, the access request may communicate a device unique identifier. The server 1035 may determine the at least one feature matches at least one stored feature. For example, a user may establish with the server 1035 a list of devices that can unlock a front door based on the device's unique identification. The server 1035 may further validate a user with facial recognition, for example, when the user attempts to access the door. The server 1035 may validate the access request based on the determination of a match (e.g., between the electronic device's unique identification and the stored identification). The server 1035 may send an indication of a validated access request that grants access to the second device 1020.

Figure 11:
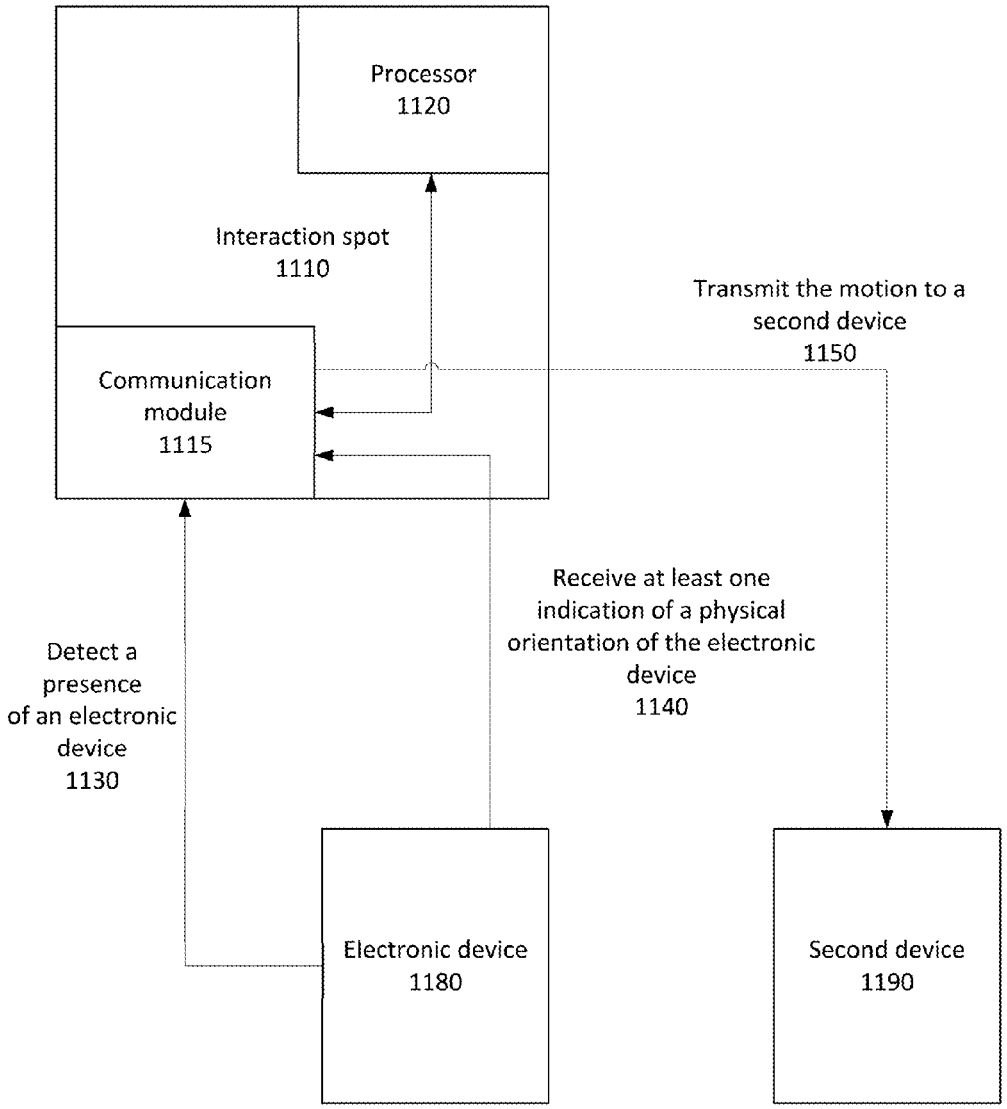
FIG. 11 is an example of a device configured to detect an electronic device and receive at least one indication of a physical orientation of the electronic device as disclosed herein.

A device 1110 is disclosed as shown in the example provided in FIG. 11 that includes a communication module 1115 and a processor 1120. The communication module 1115 may be configured to detect a presence of an electronic device 1180 in a proximity to the device 1130. The electronic device 1180 may not be detected until it is within twenty centimeters of the interaction spot (e.g., using NFC). The communication module 1115 may receive at least one indication of a physical orientation of the electronic device 1140 from the electronic device 1180. As described in implementations disclosed above, the electronic device 1180 may communicate a motion, an action based on a motion, and/or one or more indications of a physical orientation. The communication module 1115 may receive any of such signals from the electronic device 1180. The processor 1120, via the communication module, may be configured to transmit the at least one indication of a physical orientation (or motion or action) of the electronic device to a second device 1150. The processor 1120 may be notified of the receipt of physical orientation data (or motion or action) from the electronic device 1120. It may direct the communication module 1115 to transmit the information received from the electronic device 1180 to a second device 1190. In some configurations, the processor 1120 may convert the information received by the electronic device 1180 into a different signal. For example, where the electronic device 1180 communicates raw physical orientation data, the processor 1120 of the interaction 1110 spot may determine that the electronic device 1180 has been rotated ninety degrees. It may convey to the second device that the motion is ninety degrees counterclockwise rotation or that the action is to dim lights to ten percent intensity. In some configurations, the second device may be a server that is in communication with a third device (e.g., a household appliance, a light, a timer, a stereo, etc.). In configurations in which the interaction spot 1110 communicates directly with the third device, the second and third device may be the same. The electronic device 1180 and the third device are physically distinct in such an implementation.

Figure 1:
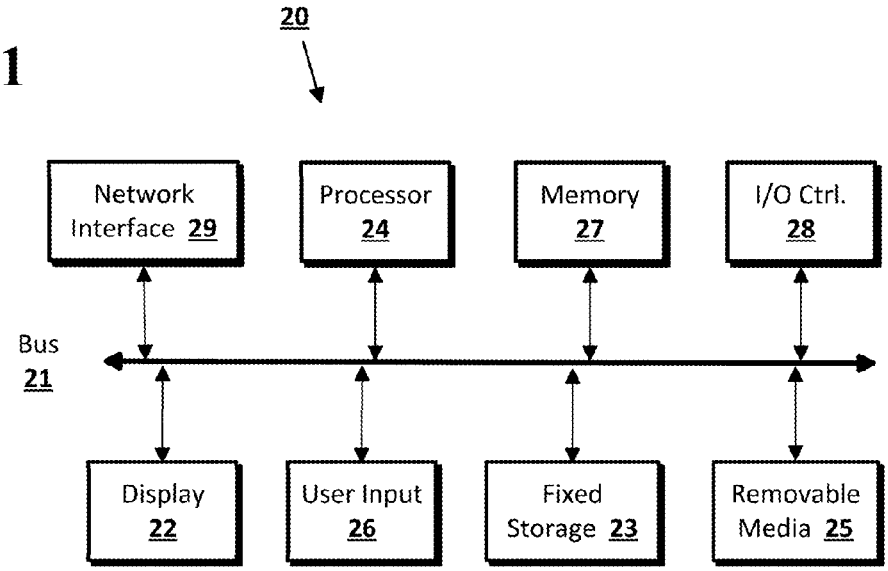
FIG. 1 shows a computer according to an implementation of the disclosed subject matter.

Implementations of the presently disclosed subject matter may be implemented in and used with a variety of component and network architectures. FIG. 1 is an example computer 20 suitable for implementations of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display screen via a display adapter, a user input interface 26, which may include one or more controllers and associated user input devices such as a keyboard, mouse, and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components. Applications resident with the computer 20 are generally stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection or the like. For example, the network interface 29 may allow the computer to communicate with other computers via one or more local, wide-area, or other networks, as shown in FIG. 2.

Many other devices or components (not shown) may be connected in a similar manner (e.g., document scanners, digital cameras and so on). Conversely, all of the components shown in FIG. 1 need not be present to practice the present disclosure. The components can be interconnected in different ways from that shown. The operation of a computer such as that shown in FIG. 1 is readily known in the art and is not discussed in detail in this application. Code to implement the present disclosure can be stored in computer-readable storage media such as one or more of the memory 27, fixed storage 23, removable media 25, or on a remote storage location.

Figure 2:
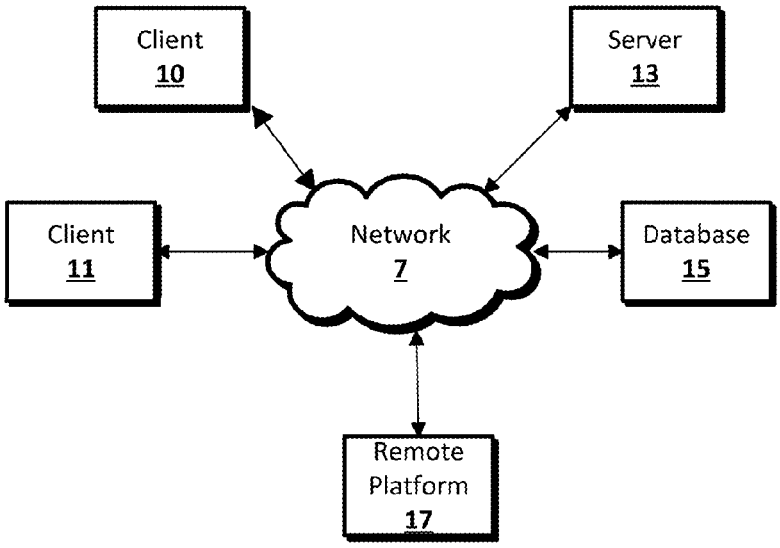
FIG. 2 shows a network configuration according to an implementation of the disclosed subject matter.

FIG. 2 shows an example network arrangement according to an implementation of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. Implementations also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Implementations may be implemented using hardware that may include a processor, such as a general purpose microprocessor and/or an Application Specific Integrated Circuit (ASIC) that implements all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

In situations in which the implementations of the disclosed subject matter collect personal information about users, or may make use of personal information, the users may be provided with an opportunity to control whether programs or features collect user information (e.g., a user's performance score, a user's work product, a user's provided input, a user's geographic location, and any other similar data associated with a user), or to control whether and/or how to receive instructional course content from the instructional course provider that may be more relevant to the user. In addition, certain data may be treated in one or more ways before it is stored or used, so that personally identifiable information is removed. For example, a user's identity may be treated so that no personally identifiable information can be determined for the user, or a user's geographic location associated with an instructional course may be generalized where location information is obtained (such as to a city, ZIP code, or state level), so that a particular location of a user cannot be determined. Thus, the user may have control over how information is collected about the user and used by an instructional course provider.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A computer-implemented method comprising:

receiving, by a presence and motion detector that is associated with an electronic device, first data from a mobile computing device;

based on the first data, determining, by the presence and motion detector, that the mobile computing device is located proximate to the presence and motion detector;

in response to determining that the mobile computing device is located proximate to the presence and motion detector, transmitting, to the mobile computing device, an instruction to display (i) a representation of an action that is controllable by changing position or orientation of the mobile computing device with respect to the presence and motion detector and while the mobile computing device is located proximate to the presence and motion detector, (ii) a representation of a particular change in position or orientation of the mobile computing device with respect to the presence and motion detector while the mobile computing device is located proximate to the presence and motion detector to perform the action, and (iii) a representation of the changed position or orientation of the mobile computing device with respect to the presence and motion detector;

receiving, by the presence and motion detector, second data from the mobile computing device;

based on the second data, determining, by the presence and motion detector, that the mobile computing device has changed position or orientation with respect to the presence and motion detector;

determining that the change in position or origination of the mobile computing device with respect to the presence and motion detector corresponds to the particular change in position or orientation of the mobile computing device with respect to the presence and motion detector; and in response to determining, by the presence and motion detector, that (i) the mobile computing device is located proximate to the presence and motion detector, and (ii) the change in position or orientation of the mobile computing device with respect to the presence and motion detector corresponds to the particular change in position or orientation of the mobile computing device with respect to the presence and motion detector, transmitting an indication of the action to be performed by the electronic device.

2. The method of claim 1, wherein the electronic device is selected from the group consisting of a household appliance, a television, a stereo, a door lock, a timer, a payment transaction device, and a light switch.

3. The method of claim 1, wherein the action to be performed by the electronic device is selected from the group consisting of a power setting, an intensity, and an access setting.

4. The method of claim 1, wherein the first data and the second data are based on data selected from the group consisting of camera data, accelerometer data, gyroscope data, magnetometer data, and GPS data.

5. The method of claim 1, wherein the presence and motion detector includes a communication module that is configured to communicate using a technique selected from the group consisting of near-field communication, radio frequency identification, local area network, inductive detector, magnetic detector, and short range radio.

6. The method of claim 1, wherein presence and motion detector is integrated with the electronic device.

7. The method of claim 1, wherein the presence and motion detector is separate from the electronic device.

8. The method of claim 1, comprising:

receiving, by the presence and motion detector that is associated with an electronic device, data identifying the mobile computing device; and in response to determining, by the presence and motion detector, that (i) the mobile computing device is located proximate to the presence and motion detector, and (ii) the mobile computing device has changed position or orientation with respect to the presence and motion detector, transmitting, by the presence and motion detector, the data identifying the mobile computing device for authentication by a server.

9. The method of claim 1, wherein determining, by the presence and motion detector, that the mobile computing device has changed position or orientation with respect to the presence and motion detector comprises:

determining that the mobile computing device has rotated about an axis intersecting the presence and motion detector and the mobile computing device.

10. The method of claim 1, wherein determining, by the presence and motion detector, that the mobile computing device has changed position or orientation with respect to the presence and motion detector comprises:

determining that the mobile device has moved within a plane that is parallel to a plane defined by the presence and motion detector.

11. The method of claim 1, comprising:

receiving, by the presence and motion detector, a selection of the electronic device, wherein the indication of the action to be performed by the mobile device is further in response to receiving the selection of the electronic device.

12. A system comprising:

one or more computers and one or more storage devices storing instructions that are operable, when executed by the one or more computers, to cause the one or more computers to perform operations comprising:

receiving, by a presence and motion detector that is associated with an electronic device, first data from a mobile computing device;

based on the first data, determining, by the presence and motion detector, that the mobile computing device is located proximate to the presence and motion detector;

in response to determining that the mobile computing device is located proximate to the presence and motion detector, transmitting, to the mobile computing device, an instruction to display (i) a representation of an action that is controllable by changing position or orientation of the mobile computing device with respect to the presence and motion detector and while the mobile computing device is located proximate to the presence and motion detector, (ii) a representation of a particular change in position or orientation of the mobile computing device with respect to the presence and motion detector while the mobile computing device is located proximate to the presence and motion detector to perform the action, and (iii) a representation of the changed position or orientation of the mobile computing device with respect to the presence and motion detector;

receiving, by the presence and motion detector, second data from the mobile computing device;

based on the second data, determining, by the presence and motion detector, that the mobile computing device has changed position or orientation with respect to the presence and motion detector;

determining that the change in position or origination of the mobile computing device with respect to the presence and motion detector corresponds to the particular change in position or orientation of the mobile computing device with respect to the presence and motion detector; and in response to determining, by the presence and motion detector, that (i) the mobile computing device is located proximate to the presence and motion detector, and (ii) the change in position or orientation of the mobile computing device with respect to the presence and motion detector corresponds to the particular change in position or orientation of the mobile computing device with respect to the presence and motion detector, transmitting an indication of the action to be performed by the electronic device.

13. The system of claim 12, wherein the electronic device is selected from the group consisting of a household appliance, a television, a stereo, a door lock, a timer, a payment transaction device, and a light switch.

14. The system of claim 12, wherein the action to be performed by the electronic device is selected from the group consisting of a power setting, an intensity, and an access setting.

15. The system of claim 12, wherein the first data and the second data are based on data selected from the group consisting of camera data, accelerometer data, gyroscope data, magnetometer data, and GPS data.

16. The system of claim 12, wherein the presence and motion detector includes a communication module that is configured to communicate using a technique selected from the group consisting of near-field communication, radio frequency identification, local area network, inductive detector, magnetic detector, and short range radio.

17. The system of claim 12, wherein presence and motion detector is integrated with the electronic device.

18. The system of claim 12, wherein the presence and motion detector is separate from the electronic device.

19. The system of claim 12, wherein the operations further comprise:

receiving, by the presence and motion detector that is associated with an electronic device, data identifying the mobile computing device; and in response to determining, by the presence and motion detector, that (i) the mobile computing device is located proximate to the presence and motion detector, and (ii) the mobile computing device has changed position or orientation with respect to the presence and motion detector, transmitting, by the presence and motion detector, the data identifying the mobile computing device for authentication by a server.

20. The system of claim 12, wherein determining, by the presence and motion detector, that the mobile computing device has changed position or orientation with respect to the presence and motion detector comprises:

determining that the mobile computing device has rotated about an axis intersecting the presence and motion detector and the mobile computing device.

21. The system of claim 12, wherein determining, by the presence and motion detector, that the mobile computing device has changed position or orientation with respect to the presence and motion detector comprises:

determining that the mobile device has moved within a plane that is parallel to a plane defined by the presence and motion detector.

22. The system of claim 12, wherein the operations further comprise:

receiving, by the presence and motion detector, a selection of the electronic device, wherein the indication of the action to be performed by the mobile device is further in response to receiving the selection of the electronic device.

23. A non-transitory computer-readable medium storing software comprising instructions executable by one or more computers which, upon such execution, cause the one or more computers to perform operations comprising:

receiving, by a presence and motion detector that is associated with an electronic device, first data from a mobile computing device;

based on the first data, determining, by the presence and motion detector, that the mobile computing device is located proximate to the presence and motion detector;

in response to determining that the mobile computing device is located proximate to the presence and motion detector, transmitting, to the mobile computing device, an instruction to display (i) a representation of an action that is controllable by changing position or orientation of the mobile computing device with respect to the presence and motion detector and while the mobile computing device is located proximate to the presence and motion detector, (ii) a representation of a particular change in position or orientation of the mobile computing device with respect to the presence and motion detector while the mobile computing device is located proximate to the presence and motion detector to perform the action, and (iii) a representation of the changed position or orientation of the mobile computing device with respect to the presence and motion detector;

receiving, by the presence and motion detector, second data from the mobile computing device;

based on the second data, determining, by the presence and motion detector, that the mobile computing device has changed position or orientation with respect to the presence and motion detector;

determining that the change in position or origination of the mobile computing device with respect to the presence and motion detector corresponds to the particular change in position or orientation of the mobile computing device with respect to the presence and motion detector; and n response to determining, by the presence and motion detector, that (i) the mobile computing device is located proximate to the presence and motion detector, and (ii) the change in position or orientation of the mobile computing device with respect to the presence and motion detector corresponds to the particular change in position or orientation of the mobile computing device with respect to the presence and motion detector, transmitting an indication of the action to be performed by the electronic device.

24. The medium of claim 23, wherein the electronic device is selected from the group consisting of a household appliance, a television, a stereo, a door lock, a timer, a payment transaction device, and a light switch.

25. The medium of claim 23, wherein the action to be performed by the electronic device is selected from the group consisting of a power setting, an intensity, and an access setting.

26. The medium of claim 23, wherein the first data and the second data are based on data selected from the group consisting of camera data, accelerometer data, gyroscope data, magnetometer data, and GPS data.

27. The medium of claim 23, wherein the presence and motion detector includes a communication module that is configured to communicate using a technique selected from the group consisting of near-field communication, radio frequency identification, local area network, inductive detector, magnetic detector, and short range radio.

28. The medium of claim 23, wherein the operations further comprise:

receiving, by the presence and motion detector that is associated with an electronic device, data identifying the mobile computing device; and in response to determining, by the presence and motion detector, that (i) the mobile computing device is located proximate to the presence and motion detector, and (ii) the mobile computing device has changed position or orientation with respect to the presence and motion detector, transmitting, by the presence and motion detector, the data identifying the mobile computing device for authentication by a server.

29. The medium of claim 23, wherein determining, by the presence and motion detector, that the mobile computing device has changed position or orientation with respect to the presence and motion detector comprises:

determining that the mobile computing device has rotated about an axis intersecting the presence and motion detector and the mobile computing device.

30. The medium of claim 23, wherein determining, by the presence and motion detector, that the mobile computing device has changed position or orientation with respect to the presence and motion detector comprises:

determining that the mobile device has moved within a plane that is parallel to a plane defined by the presence and motion detector.

31. The method of claim 1, wherein the action is controllable by the mobile device only while the mobile computing device is located proximate to the presence and motion detector.

* * * * *